US005444922A

United States Patent [19]

Ubelhor

[11] Patent Number: 5,444,922

[45] Date of Patent: Aug. 29, 1995

[54] CORRUGATED PRODUCT DRYER

[75] Inventor: Paul L. Ubelhor, Evansville, Ind.

[73] Assignee: George Koch Sons, Inc., Evansville, Ind.

[21] Appl. No.: 303,163

[22] Filed: Sep. 8, 1994

[51] Int. Cl.[6] ..... F26B 19/00

[52] U.S. Cl. ..... 34/210; 34/211; 34/222; 34/227; 34/218; 34/451

[58] Field of Search ..... 34/210, 211, 222, 227, 34/259, 422, 451, 489, 204, 218, 219, 191

[56] References Cited

U.S. PATENT DOCUMENTS

| | | | |
|---|---|---|---|
| 314,640 | 3/1885 | Andrews . | |
| 493,467 | 3/1893 | Baker | 34/61 |
| 1,011,971 | 12/1911 | Kikkuck | 34/61 |
| 1,215,760 | 2/1917 | Barnes | 34/61 |
| 1,533,480 | 4/1925 | Stricker | 34/162 |
| 1,589,642 | 6/1926 | Harris | 34/162 |
| 1,967,609 | 7/1934 | Corcoran | 34/162 |
| 2,038,228 | 4/1936 | Leslie | 34/61 |
| 2,090,168 | 8/1937 | Williams | 34/162 |
| 2,322,884 | 10/1943 | Ackerman et al. | 34/61 |
| 3,239,944 | 3/1966 | Gebert | 34/61 |
| 3,418,725 | 12/1968 | Ruud | 34/61 |
| 3,739,490 | 6/1973 | Comstock | 34/162 |
| 3,875,680 | 4/1975 | Back et al. | 34/61 |
| 4,169,007 | 9/1979 | Pray | 156/380 |
| 4,286,392 | 9/1981 | Viland | 34/47 |
| 4,419,173 | 12/1983 | Akiyama et al. | 156/470 |
| 4,513,351 | 4/1985 | Davis et al. | 34/162 |
| 4,578,881 | 4/1986 | Karlsson | 34/151 |
| 5,181,330 | 1/1993 | Schoch | 361/384 |
| 5,295,309 | 3/1994 | Kozlowski et al. | 34/23 |

FOREIGN PATENT DOCUMENTS 738345 10/1955 United Kingdom .

*Primary Examiner*—Henry A. Bennet
*Assistant Examiner*—Siddharth Ohri
*Attorney, Agent, or Firm*—Barnes & Thornburg

[57] ABSTRACT

The invention relates to a single pass airflow apparatus for cooling and drying corrugated product having open flutes, comprising an airflow exhaust duct having a first cross-sectional area, an inlet plenum with a cross-section area greater than the airflow exhaust duct and having an exit in airflow communication with an inlet to the airflow exhaust duct. The plenum has an open faced chamber abuttingly facing the stack of corrugated product which presents the open flutes to the plenum. A fan is provided for drawing airflow through corrugated product into the plenum and from there into airflow exhaust duct from whence the drawn air is exhausted to atmosphere. The invention is directed to the structure and to the method of its use.

12 Claims, 2 Drawing Sheets

CORRUGATED PRODUCT DRYER

BACKGROUND AND SUMMARY OF THE INVENTION

The present invention relates to corrugated product dryers. More particularly, the present invention relates to dryers that draw air through corrugations in the corrugated product, often referred to as "corrugated board".

Corrugated product is formed by gluing corrugated medium in between two corrugated liners. The corrugated product is strong and lightweight and is used for many purposes including boxes, shipping containers and trays.

When the corrugated product is initially produced, it is very hot and very wet. Currently, corrugated product is held in inventory for approximately eight to twelve hours to allow the product to cool and dry before it can be moved down the production line for subsequent operations. These subsequent operations include cutting and folding the corrugated product into a final product form such as shipping containers or trays and printing on the corrugated product.

Another subsequent operation that may take place is the application of hot wax curtain coating. Excess heat in the corrugated product causes the curtain coated wax to saturate into the corrugated product rather than laying wax on the surface of the product. Curtain coated wax needs to lay on the surface of the corrugated product to form an effective moisture barrier when the corrugated product is used as a shipping container to ship perishable items.

White or colored liners are used to produce corrugated product when greater aesthetics is required. These white or colored liners can become discolored when heat carries wax from the medium or moisture, from the glue used to bond the corrugated medium to the liner, through the liner. The longer the corrugated product stays hot and wet, the greater the possibility that the liners may be discolored.

The eight to twelve hour storage time required to allow the corrugated product to cool before it is transferred to these subsequent processes requires a lot of floor space which complicates material handling and occupies space that may be used for production. The long storage time of the hot and wet corrugated product also contributes to the discoloration of the special white and colored liners.

What is needed is a corrugated product dryer that cools and dries corrugated product very quickly. This dryer would reduce the warehouse space it takes to house the hot and wet corrugated product while it is cooling and drying.

In accordance with the present invention, a corrugated product dryer includes an airflow duct, a fan situated in the airflow duct, and a plenum having a first side in airflow communication with the airflow duct and an open second side facing toward the corrugated product during the drying process.

Advantageously, the fan draws airflow through the corrugated product and into the plenum. The airflow then travels through the airflow duct where it is exhausted out of the dryer. The airflow is drawn through the corrugated product through gaps or flutes formed between the liner and corrugated medium.

In preferred embodiments of the present invention, the fan and plenum are sized to create a uniform pressure across the second side of the plenum facing the corrugated product. This uniform pressure permits an approximately equal airflow to flow through all portions of the corrugated product.

Illustratively, the plenum includes a side wall defining an open-faced chamber opening towards the corrugated product and the dryer further includes bristles appended to the side wall and facing toward the dryer. The corrugated product abuts against the bristles so that a gap between the dryer and corrugated product does not form. If such a gap were allowed, airflow would enter the plenum through the gap and not through the corrugated product.

Additional features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
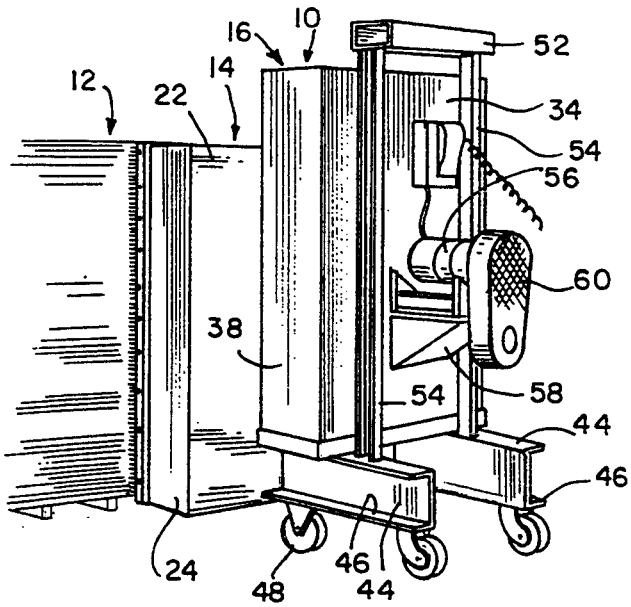
FIG. 1 is a perspective view of a corrugated product dryer in accordance with the present invention positioned adjacent to stacks of corrugated product.
Figure 2:
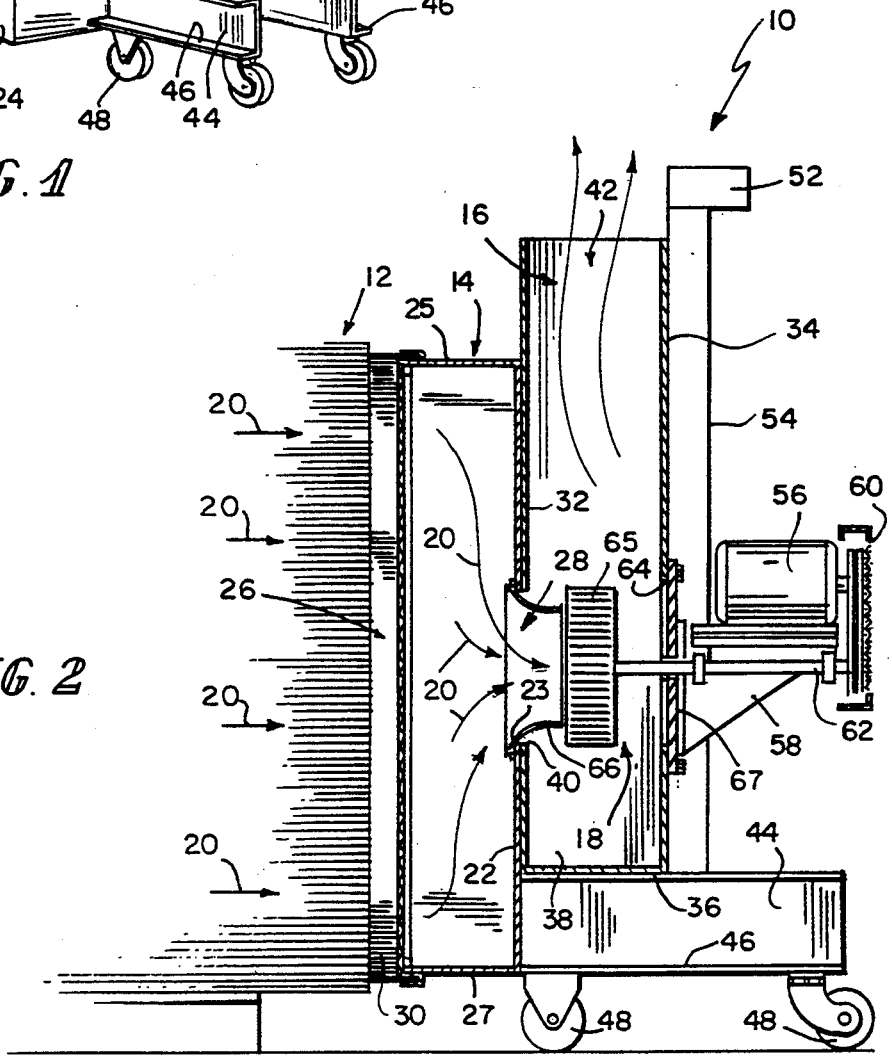
FIG. 2 is a sectional view taken along line 2—2 of FIG. 1 showing the corrugated product dryer including a plenum situated adjacent to the corrugated product, an airflow duct in airflow communication with the plenum, and a fan positioned in the airflow duct that draws air through the corrugated product and into the plenum and airflow duct.
Figure 3:
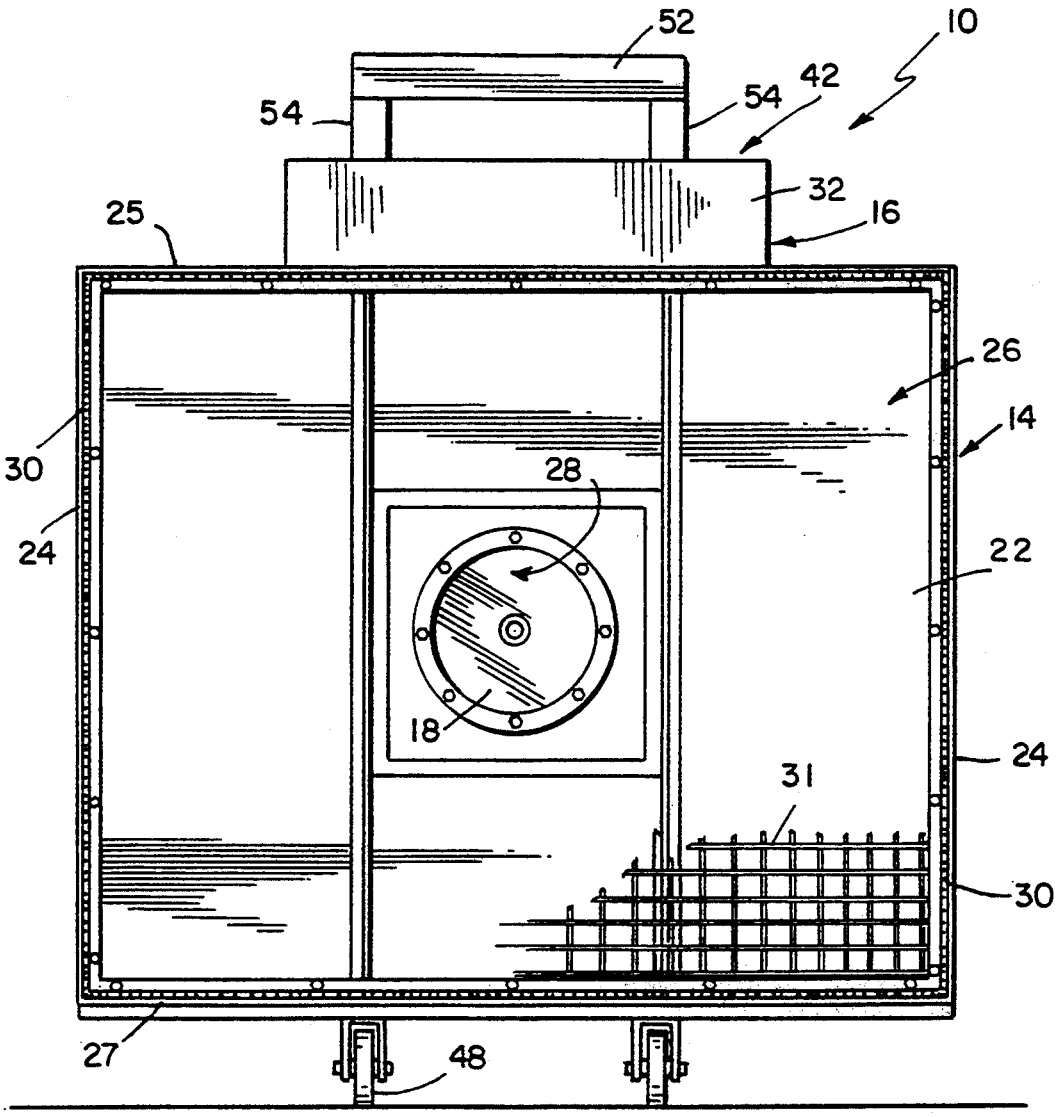
FIG. 3 is a elevational view of the corrugated product dryer of FIG. 1 showing the plenum, and airflow duct inlet connecting the plenum and airflow duct, and the fan positioned adjacent to the airflow duct inlet.

A corrugated product dryer 10 in accordance with the present invention is illustrated in FIGS. 1–3. The dryer 10 is situated next to a stack of corrugated product 12 so that the dryer 10 can induce an airflow 20 through the product 12 and into the dryer 10 as shown in FIG. 2. The dryer 10 can be moved to stacks of product 12 or the product 12 can be moved to a stationary dryer 10.

The dryer 10 includes a plenum 14, an airflow duct 16, and a fan 18. The fan 18 draws airflow 20 through the product 12 and into the plenum 14. The airflow 20 then passes through the airflow duct 16 where it is exhausted out of the dryer 10. Advantageously, the dryer 10 pulls airflow 20 through the product 12 instead of blowing airflow 20 through the product 12.

The plenum 14 includes a plenum inside wall 22, and plenum side walls 24, top wall 25, and bottom wall 27 defining an open-faced chamber 26. The plenum inside wall 22 is appended to the airflow duct 16 and is formed to include an aperture 23 defining an airflow duct inlet 28. The airflow duct inlet 28 permits airflow 20 to flow from the plenum 14 into the airflow duct 16. The open-faced chamber 26 faces toward the product 12 as shown in FIG. 2. Airflow 20 is drawn into the dryer 10 by sizing the fan 18 and plenum 14 to generate a vacuum across the open-faced chamber 26 of the plenum 14.

In preferred embodiments of the present invention, the velocity of the airflow 20 drawn through the product 12 is between 500 and 700 feet per minute. The velocity is highest for the airflow 20 directed toward the center of the plenum 14. The velocity decreases as the airflow 20 comes through the product 12 at points further away from the center of the plenum 14. If the fan 18 draws lower velocities, then the airflow 20 will only travel through portions of the product 12 on line with the center of the plenum 14. If the velocity of airflow 20 is too fast, then the airflow 20 will not efficiently exchange energy with the hot and wet product 12. Typically, the velocity of the airflow 20 is highest through the center of the stack of corrugated product 12 because the hottest and wettest portion of the corrugated product 12 is at the center of the stack.

In preferred embodiments of the invention, a bristle brush 30 is appended to the plenum side walls 24, top wall 25, and bottom wall 27 to prevent a gap from forming between the product 12 and the dryer 10. If a gap were to form, the airflow 20 would be drawn into the plenum 14 through the gap instead of through the product 12. In the illustrated embodiment, a screen 31 is appended to the plenum side walls 24, top wall 25, and bottom wall 27 and extends across the open-faced chamber 26.

The airflow duct 16 includes an airflow duct inside wall 32, airflow duct outside wall 34, airflow duct bottom wall 36, and airflow duct end walls 38 as shown in FIGS. 1–2. Airflow duct inside wall 32 is appended to the plenum inside wall 22. The airflow duct inside wall 32 is formed to include an aperture 40 to define the airflow duct inlet 28 with aperture 23 formed in plenum inside wall 22. Airflow 20 enters the airflow duct 16 through the airflow duct inlet 28 and passes in between walls 32, 34, 36, 38 to an airflow duct outlet 42 where the airflow 20 can be exhausted into the plant or through additional airflow ducting (not shown) outside the plant. For example, it may be desirable to exhaust the hot and moist air into the plant during the cooler months of the year and outside of the plant during the warmer months of the year.

The airflow duct bottom wall 36 is situated on a base 44 as shown in FIGS. 1–2. The base 44 includes a bottom side 46 that lies in the same plane as the plenum bottom wall 27. In the illustrated embodiment of the present invention, the base 44 includes two spaced-apart pieces of 10" channel. However, in alternative embodiments of the present invention, any other suitable structure may be used for a base 44 or the airflow duct bottom wall 36 may be in the same plane as the plenum bottom wall 27.

Also in the illustrated embodiment of the present invention, casters 48 are positioned on the bottom side of dryer 10 as shown in FIGS. 1–3. In preferred embodiments, the casters are situated on the bottom side 46 of base 44 to elevate the plenum 14 off of the plant floor. Advantageously, the placement of the casters 48 permit the plenum 14 to telegraph over a floor conveyor or similar device (not shown to abut with the corrugated product 12. The casters 48 are used to move the dryer 10 to different locations in the plant and to abut the dryer 10 with the corrugated product 12 to ensure that a gap is not present between the corrugated product and the dryer. In alternative embodiments of the present invention, when casters 48 are not used a structural support (not shown) may be placed on the bottom side 46 of the base 44 to elevate the plenum 14 off of the plant floor.

Another means for moving the dryer 10 is a channel 52 positioned at the top of the dryer 10. The channel 52 is supported by spaced-apart channel supports 54 that are appended to the base 44 and the airflow duct outside wall 34.

In the preferred embodiments of the present invention, the fan 18 is driven by a motor 56. A motor support 58 is appended to the airflow duct outside wall 34 to support the motor 56, a belt/pulley drive apparatus 60, and a drive shaft 62. The belt/pulley drive apparatus 60 transfers rotation generated by the motor 56 to the drive shaft 62. The drive shaft 62 extends through the airflow duct outside wall 34 to connect the belt/pulley drive apparatus 60 and the fan 18. In alternative embodiments of the present invention, other sources of power may be used to drive the fan 18.

In the illustrated embodiment, a single fan 18 is used to draw airflow 20 through the product 12. In alternative embodiments, multiple fans may be used.

In preferred embodiments of the present invention, the fan 18 is a conventional plug fan that can be purchased from New York Blower in Willowbrook, Ill. However, in alternative embodiments of the present invention, any suitable fan or blower device may be used to draw air through the product 12.

The conventional plug fan 18 includes a wheel 65 and an inlet cone 66. The wheel 65 rotates inside of the airflow duct 16 to draw the airflow 20 into the plenum 14. The airflow 20 is directed from the plenum 14 through the inlet cone 66 and into the center of the wheel 65. The airflow 20 is then directed from the wheel 65 to the airflow duct outlet 42.

In preferred embodiments of the present invention, the plug fan 18 is part of a unit including the motor 56, motor support 58, torque converter 60, drive shaft 62, and a mounting plate 67. In this preferred embodiment, the airflow duct outside wall 34 is formed to include an aperture 64 as shown in FIG. 2. During assembly, plug fan 18 and drive shaft 62 extend through the aperture 64 and into the airflow duct 16. The mounting plate 67 mounts onto the airflow duct outside wall 34 to cover the aperture 64. The inlet cone 66 is appended to the plenum inside wall 22 as shown in FIG. 2. In alternative embodiments, structural support (not shown) may be added to the portion of the airflow duct outside wall 34 where the mounting plate 67 is attached.

Figure 4:
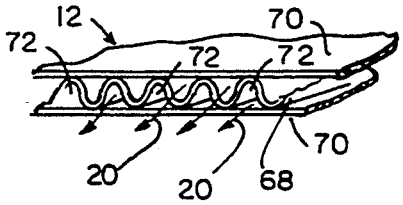
FIG. 4 is an enlarged perspective view of the corrugated product showing the corrugated medium situated between two corrugated liners and how the airflow is drawn through gaps or flutes formed between the corrugated medium and corrugated liners.

Airflow 20 is drawn through the product 12 as shown in FIG. 4. The product 12 conventionally includes a corrugated medium 68 positioned between two corrugated liners 70. The airflow 20 travels through gaps or flutes 72 in between the medium 68 and the liners 70.

Drawing airflow 20 through the flutes 72 and the product 12 rapidly removes heat and moisture from stacks of product 12. By removing heat and moisture quickly from the stack or stacks of product 12, the amount of inventory space required to hold product 12 while it is cooling and drying is reduced and subsequent operations such as cutting, folding, and printing can be performed sooner. In addition, quickly cooling and drying the product 12 prevents the glue used to bond the medium 68 and liner 70 from discoloring the liners 70.

During the cooler months of the year, it is anticipated that plant air can be used to supply air to cool the stacks of product 12. During the warmer months of the year, air can be supplied from inside or outside the plant. However, during the warmer months of the year, cooling can be enhanced by using a refrigerated air supply system to supply cooler air to the stacks of product 12.

Preliminary tests have demonstrated in a corrugated plant's production floor that the dryer 10 can dry and cool a single stack of product 12 in approximately five minutes. Without the use of a dryer 10, it would take approximately eight to twelve hours to achieve the same drying and cooling of a single stack of the same size product 12.

In another test, three stacks of product 12 were arranged in series so that the air flow 20 moved through the first stack, then the second stack, and then the third stack before reaching the dryer 10. The three stacks of product 12 were cooled and dried in approximately twenty minutes.

Another test using product 12 in the form of corrugated lids was conducted. The lids were delivered to a curtain coating process line in 5'-0" high stacks and were conveyed three stacks wide in front of the dryer 10. The length of the lids, that made up the stacks, allowed the lids to be arranged two stacks lengthwise by three stacks wide for a total of six stacks of lids to be cooled simultaneously. Thermocouples were placed in the two outside stacks furthest away from the plenum 14 and two thermocouples were placed in the inside stacks situated adjacent to the plenum 14. The thermocouples were placed between liners 70 of two separate corrugated sheets. The thermocouples were not placed in the flutes 72. The test results are shown in Table 1.

TABLE 1

| | INSIDE STACKS (2 Stacks Nearest Plenum) | | OUTSIDE STACKS (2 Stacks Away From Plenum) | |
|---|---|---|---|---|
| | Stack #1 | Stack #2 | Stack #3 | Stack #4 |
| Beginning Temp. | 86° F. | 95° F. | 81° F. | 80° F. |
| +5 min. | 85° F. | 86° F. | 69° F. | 64° F. |
| +10 min. | 80° F. | 81° F. | 65° F. | 63° F. |
| +15 min. | 74° F. | 76° F. | 64° F. | 62° F. |
| +20 min. | 68° F. | 70° F. | 64° F. | 61° F. |
| +25 min. | 65° F. | 66° F. | 63° F. | 61° F. |
| +30 min. | 66° F. | 64° F. | 63° F. | 61° F. |

Another test was conducted with thermocouples placed in three new stacks of product 12 arranged in the same manner as the last test, three abreast on the conveyor supplying corrugated lids to the curtain coater. In this test, thermocouples were placed in all three stacks across the conveyor.

First, temperature measurements were made before the stacks were moved in front of plenum 14. There was no forced airflow 20 for the first twenty minutes of the test. The thermocouples were placed in approximately the same position in the stacks as the previous test. The results of the twenty minute test of no forced airflow 20 are shown in Table 2.

TABLE 2

| | Inside Stack | Middle Stack | Outside Stack |
|---|---|---|---|
| Beginning Temp. | 101° F. | 104° F. | 85° F. |
| Temp. after 20 min. | 101° F. | 104° F. | 85° F. |

These three stacks were then conveyed in front of the dryer 10. They were arranged the same as our previous test with one stack situated against plenum 14, the second stack beside it, and the third stack on the outside of the second stack and furthest from plenum 14. The results of the test are shown in Table 3.

TABLE 3

| | Inside Stack | Middle Stack | Outside Stack |
|---|---|---|---|
| Beginning Temp. | 103° F. | 103° F. | 83° F. |
| +1 min. | 104° F. | 100° F. | 81° F. |
| +2 min. | 104° F. | 97° F. | 79° F. |
| +3 min. | 103° F. | 95° F. | 77° F. |
| +4 min. | 101° F. | 93° F. | 76° F. |
| +5 min. | 99° F. | 91° F. | 74° F. |
| +6 min. | 97° F. | 89° F. | 72° F. |
| +7 min. | 95° F. | 88° F. | 71° F. |
| +8 min. | 94° F. | 86° F. | 70° F. |
| +9 min. | 93° F. | 85° F. | 69° F. |
| +10 min. | 91° F. | 84° F. | 68° F. |

Testing was also conducted on the corrugated lids to determine the amount of adhesion between the medium 68 and liners 70. These adhesion tests are known in the industry as wet pin and dry pin adhesion tests. A dry pin test is conducted on dry corrugated product 12 and a wet pin test is conducted on corrugated product 12 that has been soaked in 70° F. water for one hour.

The results of the test are shown below in Table 4. Samples #1 through #3 were dried and cooled by dryer 10 while sample #4 was static cooled for approximately eight to twelve hours. Sample #1 was obtained from a stack of corrugated lids closest to the dryer 10, sample #2 was obtained from a stack of corrugated lids furthest away from the dryer 10, and sample #3 was obtained from a stack of corrugated lids in between the stacks where samples #1 and #2 were obtained. The results indicate the amount of weight that was applied to the corrugated lids before they failed.

TABLE 4

| Sample | #1 | #2 | #3 | #4 |
|---|---|---|---|---|
| | Pin Adhesion (Dry) | | | |
| | 83 lbs. | 86 lbs. | 80 lbs. | 84 lbs. |
| | Pin Adhesion (Wet) (1 Hour @ 70°F.) | | | |
| | 9 lbs. | 8 lbs. | 8 lbs. | 12 lbs. |

Although this invention has been described in detail with reference to certain embodiments, variations and modifications exist within the scope and spirit of the invention as described and as defined in the following claims.

We claim:

1. A single pass airflow apparatus for cooling and drying corrugated product having open flutes, the apparatus comprising an airflow duct having a first cross-sectional area having an inlet and an outlet, a plenum having a first side in airflow communication with the inlet of the airflow duct and a second side open to provide an open-faced chamber in communication with a stack of corrugated product situated outside of the plenum, said second side being open abuttingly to face the stack of corrugated product which presents the open flutes to the plenum, the plenum having a second cross-sectional area greater than the first cross-sectional area, and fan means for sequentially drawing a fresh airflow charge through the corrugated product into the plenum and from there into the airflow duct through the said inlet and from the airflow duct the fresh charge of drawn airflow is exhausted directly to atmosphere through the outlet of the airflow duct, the fan means being situated in the airflow duct between its inlet and outlet.

2. An apparatus for cooling and drying corrugated product having open flutes, the apparatus comprising an airflow duct having a first cross-sectional area, a plenum having a first side in airflow communication with the airflow duct and a second side open to provide an open-faced chamber in communication with a stack of corrugated product situated outside of the plenum, said second side being open abuttingly to face the stack of corrugated product which presents the open flutes to the plenum, the plenum having a second cross-sectional area greater than the first cross-sectional area, and fan means for drawing airflow through the corrugated product into the plenum and airflow duct, the fan means being situated in the airflow duct, and further including bristles appended to the side wall of the plenum and configured to engage corrugated product.

3. The apparatus of claim 1, wherein the fan and plenum are sized to create a uniform pressure across the open-faced chamber.

4. The apparatus of claim 1, wherein the airflow duct and plenum are rectangular shaped.

5. The apparatus of claim 1, wherein the airflow duct and plenum are appended to each other.

6. The apparatus of claim 5, further including a base and the airflow duct is supported by the base.

7. The apparatus of claim 5, wherein the airflow duct is a first height and the plenum is a second height less than the first height.

8. The apparatus of claim 1, wherein the first side of the plenum includes an inside wall separating the plenum and airflow duct.

9. The apparatus of claim 1, wherein the airflow duct includes an outside wall spaced apart from the inside wall of the plenum and the fan is positioned between the outside wall and the inside wall of the plenum.

10. A method of cooling and drying corrugated products having open flutes, the method comprising the steps of providing a single pass airflow corrugated product dryer including a plenum having an open side for abuttingly positioning next to a stack of corrugated product, an airflow duct in airflow communication with the plenum, and fan means for drawing airflow into the plenum, and placing a stack of corrugated product adjacent to the open side of the plenum wherein the fan causes airflow to travel sequentially through the open flutes in the corrugated product before entering the plenum and from the plenum into the airflow duct from whence the airflow that traveled through the open flutes is exhausted to atmosphere.

11. An apparatus for cooling and drying corrugated product having open flutes, the apparatus comprising an airflow duct having a first cross-sectional area, a plenum having a first side in airflow communication with the airflow duct and a second side open to provide an open-faced chamber in communication with a stack of corrugated product situated outside of the plenum, said second side being open abuttingly to face the stack of corrugated product which presents the open flutes to the plenum, the plenum having a second cross-sectional area greater than the first cross-sectional area, fan means for drawing airflow through corrugated product into the plenum and airflow duct, the fan means being situated in the airflow duct, and wherein the first side of the plenum includes an inside wall separating the plenum and airflow duct, the inside wall being formed to include an airflow duct inlet aperture to allow airflow between the plenum and the airflow duct.

12. An apparatus for cooling and drying corrugated product having open flutes, the apparatus comprising an airflow duct having a first cross-sectional area, a plenum having a first side in airflow communication with the airflow duct and a second side open to provide an open-faced chamber in communication with a stack of corrugated product situated outside of the plenum, said second side being open abuttingly to face the stack of corrugated product which presents the open flutes to the plenum, the plenum having a second cross-sectional area greater than the first cross-sectional area, fan means for drawing airflow through corrugated product into the plenum and airflow duct, the fan means being situated in the airflow duct, and wherein the first side of the plenum includes an inside wall separating the plenum and airflow duct, the fan being positioned in the airflow duct adjacent to the airflow duct inlet.

* * * * *